US005842465A

United States Patent [19]

Cassidy

[11] Patent Number: 5,842,465

[45] Date of Patent: Dec. 1, 1998

[54] STACKABLE FIREPLACE GRATES

[76] Inventor: Harry J. Cassidy, 3125 Arrowhead Rd., Las Cruces, N. Mex. 88011

[21] Appl. No.: 870,695

[22] Filed: Jun. 9, 1997

Related U.S. Application Data

[63] Continuation-in-part of Ser. No. 491,066, Jun. 16, 1995, Pat. No. 5,636,624.

[51] Int. Cl.[6] ..... F24B 1/193; F24C 3/08

[52] U.S. Cl. ..... 126/540; 126/152 B

[58] Field of Search ..... 126/540, 541, 126/152 R, 152 A, 152 B, 163 R, 163 A

[56] References Cited

U.S. PATENT DOCUMENTS

| | | |
|---|---|---|
| Re. 28,586 | 10/1975 | Dahlquist . |
| 177,464 | 5/1876 | Brown . |
| 2,985,165 | 5/1961 | Peterson et al. . |
| 3,042,109 | 7/1962 | Peterson . |
| 3,583,845 | 6/1971 | Pulone . |
| 4,215,671 | 8/1980 | Nadolsky . |
| 4,257,392 | 3/1981 | Betenbaugh . |
| 4,360,001 | 11/1982 | Thompson . |
| 5,033,455 | 7/1991 | Eiklor et al. . |

FOREIGN PATENT DOCUMENTS

| | | |
|---|---|---|
| 2 380 498 | 8/1978 | France . |

*Primary Examiner*—Carl D. Price
*Attorney, Agent, or Firm*—Richard C. Litman

[57] ABSTRACT

Stackable fireplace grates having a minimum of widely spaced legs and posts. One or more mediate posts are positioned inside the grate and on inclined, V-shaped sloping rod members which are supported by front and rear horizontal reinforcing support members. The front and rear distances between the rod member upper ends are less than the distances separating points of connection of the horizontal reinforcing support members to the V-shaped rod members. Thus, grates can be stacked in a minimal space, adjacent grates arranged at right angles to each other, with the rod member tips of one grate fitting up through the horizontal reinforcing supports of an adjacent grate.

10 Claims, 4 Drawing Sheets

STACKABLE FIREPLACE GRATES

CROSS REFERENCE TO RELATED APPLICATION

This is a continuation-in-part of application Ser. No. 08/491,066 filed Jun. 16, 1995, now U.S. Pat. No. 5,636,624, issued Jun. 10, 1997.

BACKGROUND OF THE INVENTION

1. Field of the Invention

The present invention relates generally to fireplace grates and, more specifically, to improved, stackable fireplace grates. The fireplace grate includes one or more inner or mediate posts, which keep the firewood properly spaced for improved ignition and burning of different sized logs throughout the duration of the fire.

In the present invention, parts are strategically dimensioned and configured so that grates may be stacked one upon another, adjacent grates being arranged at right angles to one another, so that upper tip ends of a lower grate fit neatly through, up and between the horizontal supports of an upper grate. This minimizes space required for storage, shipping, warehousing, etc. of a number of the fireplace grates and provides stable and safe stacking of grates.

Following are additional features, described at great length in the parent application, now U.S. Pat. No. 5,636,624, issued Jun. 10, 1997, and incorporated herein by reference.

The metal fireplace grate can be fabricated by either welding or casting. The grate can have gas connections integrated within fixed inner posts to form a gas burning fireplace grate. A flat or slightly concave heat reflector plate can be advantageously attached on the grate in the rear with clearance for the fireplace ash packing utensils provided in combination with this innovative fireplace grate.

In the above arrangements, the base of the grate is fabricated intentionally low to maximize the effectiveness of heat-transmission. In the lower portion of the grate, unobstructed tunnel-like spaces are provided from front to rear to accommodate the use of three ash handling tools for the packing of ashes at the rear of the fireplace; later, the ashes can be easily removed with a suitable tool, such as a conventional, small fireplace shovel or the like.

2. Description of the Related Art

The following documents disclose fireplace grates having some relevance to the instant invention. None, however, teaches, discloses or suggests the particular arrangement and construction of the instant invention. These documents are discussed in the order of their perceived relevance to the invention.

U.S. Pat. No. 2,985,165 issued May 23, 1961, to John W. Peterson et al. teaches a fireplace grate having a number of open, V-configured cross slats, with posts extended vertically upwardly from the bases of selected V-configured slats. Inclined V-shaped rods permitting alternating, right-angled, nested stacking of grates is not taught by Peterson et al.

In U.S. Pat. No. Re. 28,586 issued on Oct. 28, 1975, to Emil F. Dahlquist, two fireplace grates are described which emphasize self-feeding of the piled logs wherein (1) the back portion is at a right angle to the inclined front portion or (2) the back and front portions are disposed at an obtuse angle. The grate is positioned high from the floor to include a food carrying ledge below the logs. The grate is formed from continuous bar stock and joined by welding to include horizontal cross-members for the top edges of the front and back portions. There is neither any suggestion for providing a minimum of space below the grate, nor alternate, right-angled stacking of a number of grates.

In U.S. Pat. No. 5,033,455 issued on Jul. 23, 1991, to Scott F. Eiklor et al., a gas-fired artificial log burning grate having two joined gas pipes is described. The smaller diameter pipe has a flat metallic strip inserted to effect correct gas distribution to the affected orifices. The orifice sizes can be #30 to #34. The fuel can be either natural gas or propane. Other accoutrements are a V-shaped trough, scented sticks and an igniter. The grate configuration consists of horizontally positioned squared and tubular rods bent upward in front. There is no suggestion of the particular construction of the instant invention, much less stacking of grates one upon another at alternating right angles to minimize occupied space.

In U.S. Pat. No. 177,464 issued on May 16, 1876, to Thomas Brown, a fireplace grate consisting of vertical parallel L-shaped bars with the ends joined by horizontal crossbars. The shorter leg portion is secured against the fireplace back wall while the longer leg portion has sidebars with hooks to secure against the sidewalls of the fireplace. V-shaped iron segments secure adjacent vertical bars. An ash collector is placed below the fireplace grate.

In French Patent publication No. 2,380,498 published on Sep. 8, 1978, for Michael Bott, a fireplace grate consisting of three flattened parallel grate rods shaped with a horizontal mediate portion and inclined side portions are positioned on a base plate having inclined walls. The horizontal mediate portion is supported with a crossbar. The logs are supported by the inverted, truncated V-shaped grate slats and the inclined walls of the base plate.

The following four U.S. patent documents teach and disclose various log supporting fireplace grates, but none suggest much less teach the instant invention, including outwardly inclined, V-shaped rod members, with horizontal front and rear supports, parts specifically dimensioned and configured to permit ready, alternating, right-angled stacking of fireplace grates, one upon another, to minimize occupied space of a quantity of grates. These documents are U.S. Pat. Nos.: 3,583,845 issued Jun. 8, 1971, to Ronald E. Pulone, and disclosing an open grate construction with two, vertical, upwardly-directed center posts; 4,215,671 issued Aug. 5, 1980 to Isaac Nadolsky, and teaching a grate with rear, forwardly directed and upwardly angled log supports, the grate having a mesh bed; 4,257,392 issued Mar. 24, 1981, to Walter R. Betenbaugh, and showing a grate with rear, forwardly directed supports much the same as taught by Nadolsky; and 4,360,001 issued Nov. 23, 1982, to E. Arthus Thompson, and disclosing a pair of end, vertically upright V-supports for logs.

None of the above inventions and patents, taken either singly or in combination, is seen to describe the instant invention as claimed.

SUMMARY OF THE INVENTION

The present invention is directed to a combination of a wood burning fireplace grate and accessories which enable packing, storage and removal of the ashes in the fireplace without removing the grate from the fireplace, similar in many respects to the invention disclosed and claimed in my prior U.S. Pat. No. 5,636,624, issued Jun. 10, 1997. More particularly, however, the novel fireplace grate comprises curvilinear front and rear, upright or inclined, horizontal support members with a pair of outwardly inclined, V-shaped rod members attached (as by welding)

therebetween, each having a center post lying in the same plane of inclination or, alternatively, standing in a position that ranges from inclined to vertically upright, the outer, upper tip ends of the V-shaped rod members strategically dimensioned so as to fit upwardly and through the horizontal support members of another grate of similar construction stacked thereupon, and at right angles thereto. Grates may be stacked in alternating, right-angled fashion, one upon another, so as to minimize space occupied, thus significantly reducing storage, shipping and warehousing costs. At the same time, however, a most suitably strong and long-lasting fireplace grate is provided.

Equally importantly, the important features taught in my prior U.S. Pat. No. 5,636,624 are retained. These features are summarized as follows.

The grate is made up of leg members supporting one or more substantially V-shaped and sloping upright rod members having either a flat, curved or stepped bottom which provides for the placement of kindling wood at the bottom of the wood pile. Reinforcing support members (which are optional) brace the leg portions proximate to their ends. One or more mediate located vertical or inclined post members separate the kindling and logs into two distinct front and rear piles. This arrangement provides for the essential updraft of air required for complete combustion between piles.

The mediate vertical or inclined post members can be either permanently positioned (or alternatively movable by the use of clamps at their bases) on the sloping post members at the bottom of the V or on the reinforcing parallel support members. The mediate post members can be inclined towards the front from their bases or proximate to their top regions. The mediate post members are preferably positioned towards the front to permit the placement of larger logs in the rear. The mediate post members can be smaller at their bases to provide more space for the placement of kindling wood at the base of the grate. The base portions of the V-shaped post members can be either resting on or elevated from the fireplace floor. If the former position is contemplated, the front and rear legs can be omitted. If a stepped bottom for V-shaped posts is utilized, only the front legs are required.

The fireplace accessories include a long-handled tool or utensil with either a triangular plate, a truncated triangular plate or a rectangular plate at the opposite end for packing the ashes against the fireplace back wall after the ashes have collected on the fireplace floor. These utensils are dimensioned to travel through tunnel-like openings defined by the substantially vertical grate members. After the ashes from numerous fires are compacted, ash is removed by use of a conventional fireplace shovel, back through the available tunnel-like openings, and discarded. Another fireplace accessory is the provision for a reflector plate having either a flat or slightly concave surface on the rear of the novel grate and elevated to permit clearance for ash packing and removal.

Accordingly, it is a principal object of the invention to provide a woodburning fireplace grate with a minimum of legs and posts and have outwardly inclined, V-shaped rod members resting on horizontal support members, parts being dimensioned and configured so that grates can be stacked in a minimal space and with maximum stability, adjacent grates arranged at right angles to each other, with the rod member tips of one grate fitting up through the horizontal reinforcing supports of an adjacent grate.

It is another object of the invention to provide stackable fireplace grates having mediate log support posts within outwardly inclined V-shaped rod members, the posts lying in the same planes as the respective plane of inclination of each rod member, or standing in a position that ranges from inclined to vertically upright.

It is a further object of the invention to provide stackable fireplace grates with front and rear horizontal supports and intermediate, outwardly inclined V-shaped rod members, parts arranged, dimensioned and configured to cooperatively define a first unobstructed, front-to-rear tunnel between the V-shaped rod members and each horizontal central leg portion, and second and third unobstructed, front-to-rear tunnels between each V-shaped rod member and each descending outer leg portion, respectively, whereby a user can conveniently remove ash with a conventional fireplace shovel, while the grate remains in place in the fireplace.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
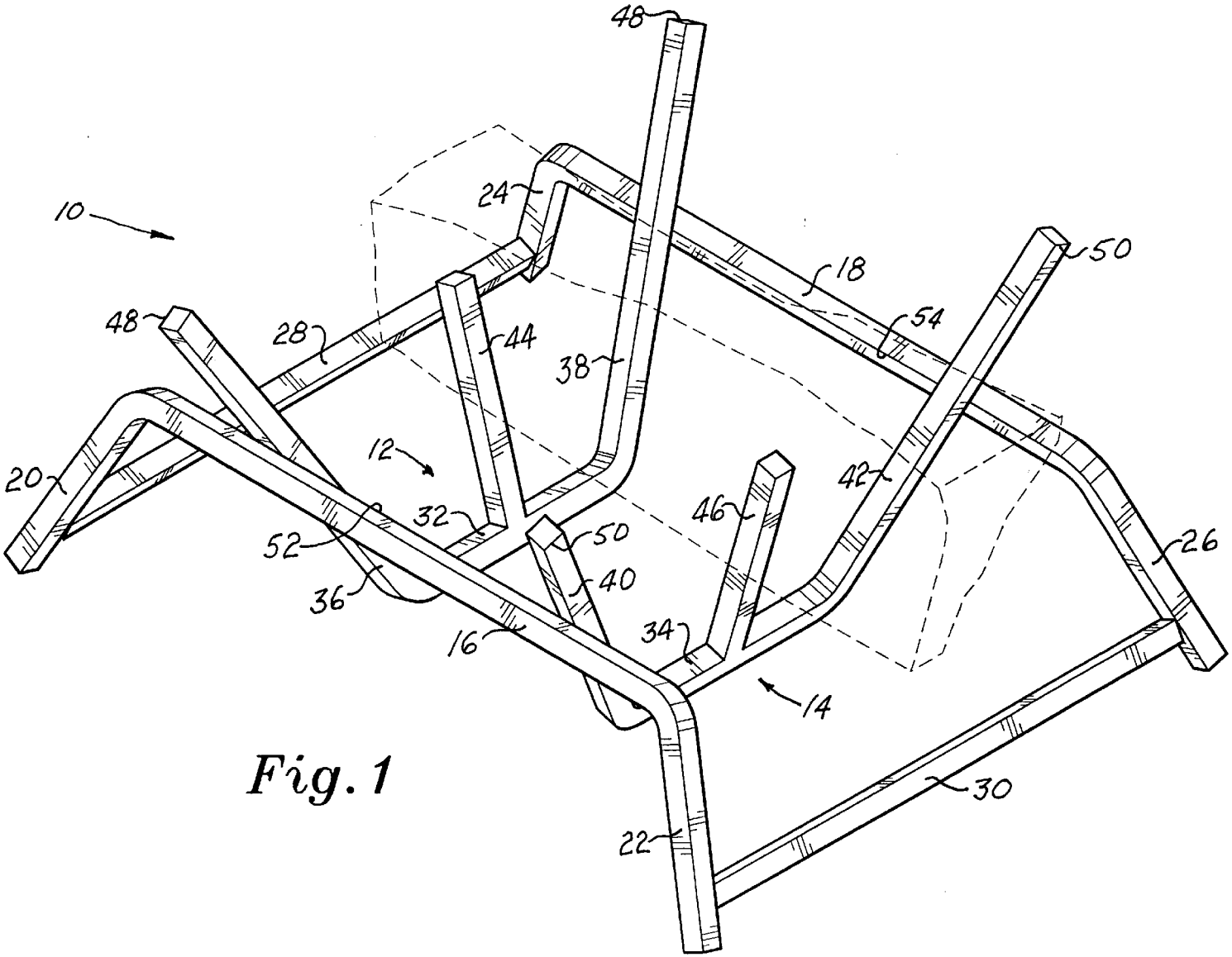
FIG. 1 is an environmental, front perspective view of the invention, with a log illustrated in phantom lines.

Referring now to the drawings by reference character and particularly to FIG. 1, a fireplace grate 10 constructed in accordance with the principles of the instant invention is depicted.

Figure 2:
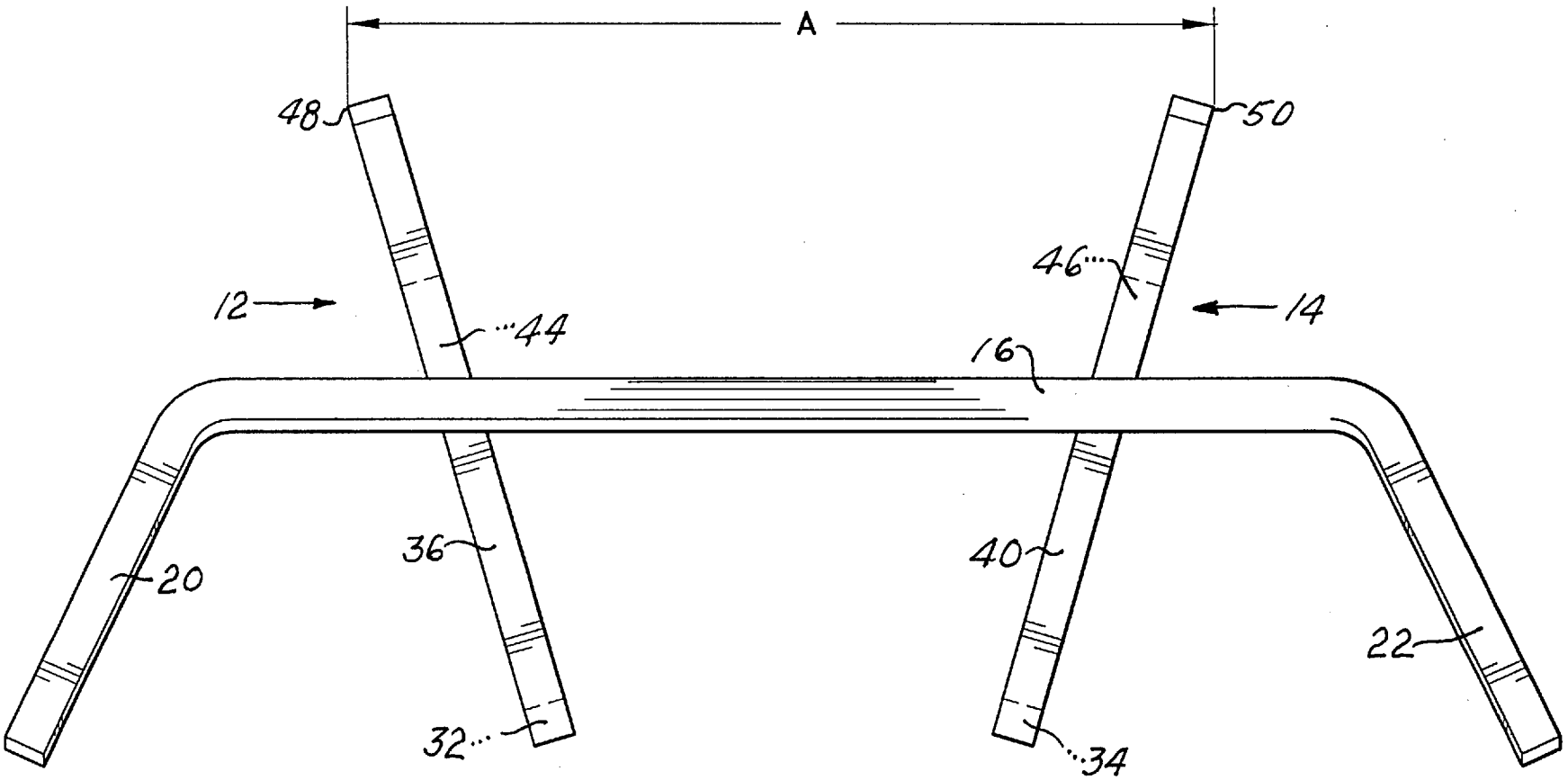
FIG. 2 is an enlarged scale, front elevational view of the invention as seen in FIG. 1.
Figure 3:
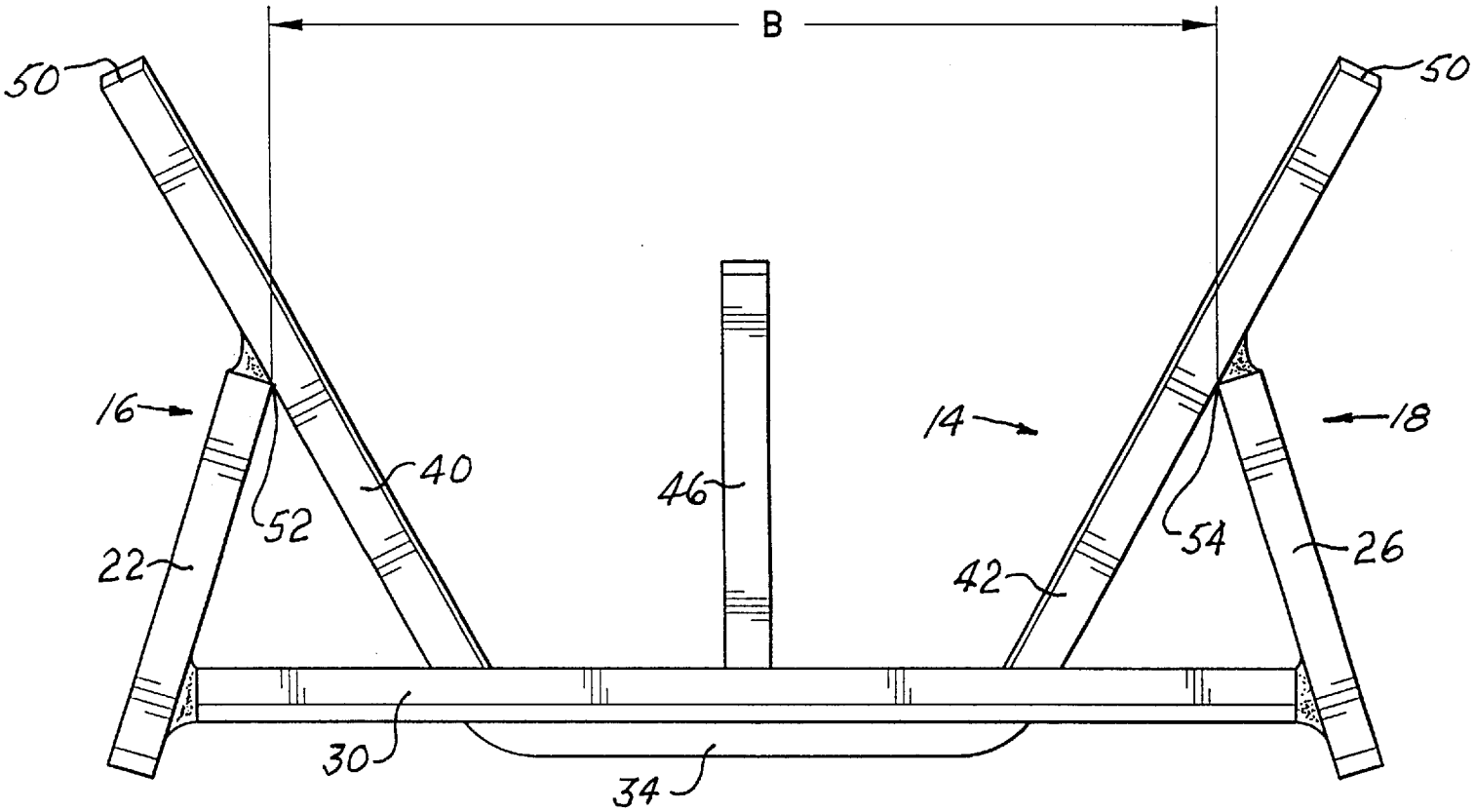
FIG. 3 is a right side, end elevational view of the invention as seen in FIG. 2.

FIGS. 1–3 illustrate the preferred embodiment of a welded fireplace grate. Alternatively, the fireplace grate is made of cast iron members having a square cross-section which are aligned to present an edge or corner to the piled wood to minimize contact. Alternatively, the iron members can be made of wrought iron bars, having either a circular cross-section, or a rectangular cross-section, again with the requirement of presenting minimum contact with the wood.

Fireplace grate 10 is made up of a first and second V-shaped rod member 12, 14, respectively, the rod members being outwardly inclined from one another. The rod members are supported by a front and a rear horizontal reinforcing support member 16, 18, respectively. The respective ends of supports 16, 18, have outwardly angled support legs 20, 22, and 24, 26, respectively. In the preferred embodiment of the invention, reinforcing side or end support members 28, 30 are welded between legs 20–24, and 22–26, as clearly seen in FIG. 1.

Each V-shaped rod member 12, 14 includes an interior horizontal base portion 32, 34, respectively, having upwardly sloped front and rear arms 36, 38, and 40, 42, respectively. Centrally disposed in bases 32, 34, are posts 44, 46, respectively. The mediate posts 44, 46 and sloping arms 36–42 separate the wood logs and kindling to create spaces which enhance superior burning and complete combustion of the firewood. As shown, the posts 44, 46 lie in the same plane of inclination as that defined by the respective V-shaped rod members 12 and 14, for purposes of easy stacking of multiple grates, one upon another, as is explained in greater detail hereinbelow. In an alternate embodiment, however, the respective posts 44, 46 may be arranged in a position ranging from inclined to vertically upright.

Figure 4:
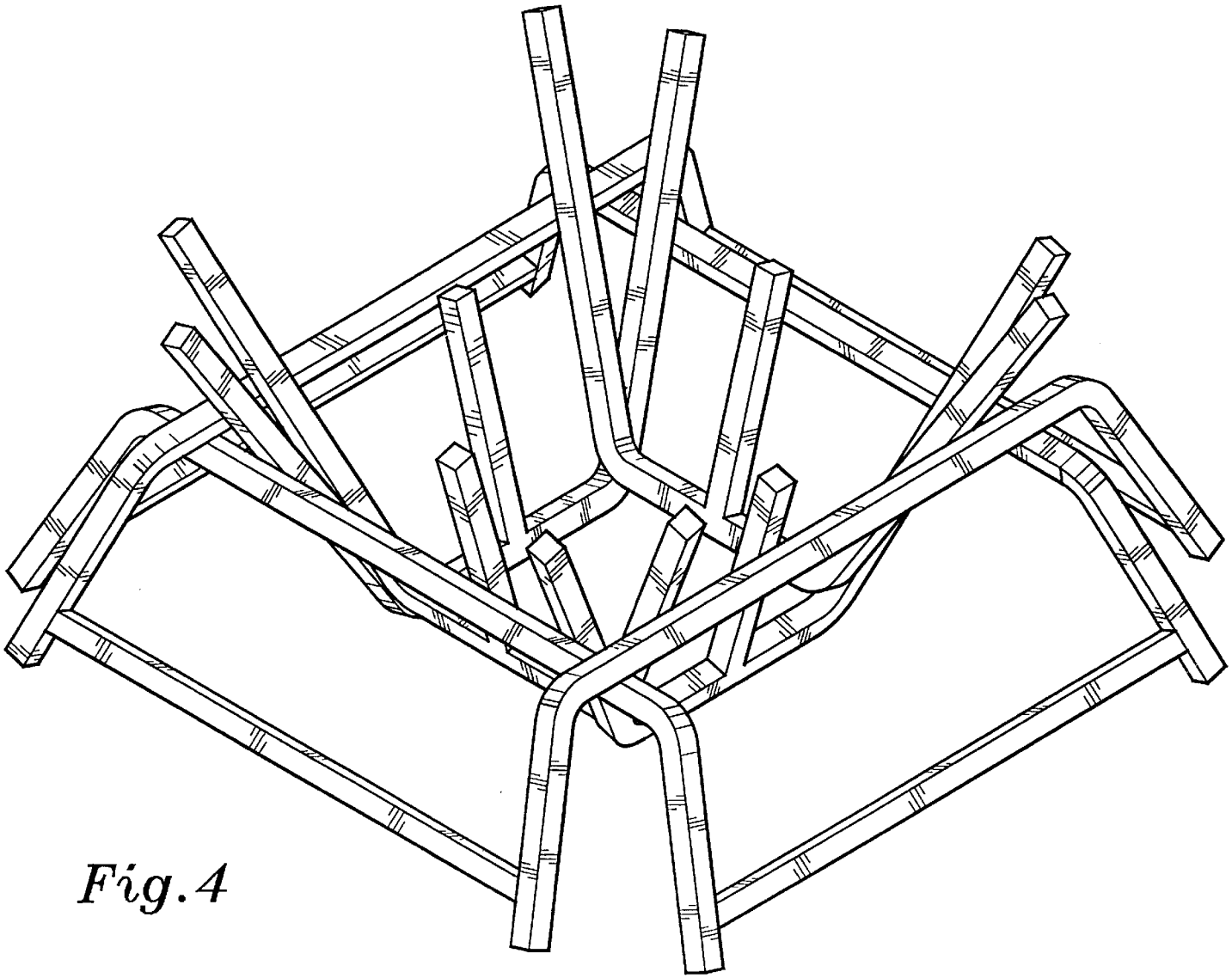
Fig. 4 is a perspective view of two grates according to the present invention stacked one upon the other.

As can best be appreciated by a study of FIG. 1, the upward arms 36, 38 of rod member 12 terminate in forward and rear tip ends 48, 48, and the arms 40, 42 of rod member 14 terminate in forward and rear tip ends 50, 50. In FIG. 2, the measured distance indicated at A between tips 48—48 and 50—50 is strategically chosen and is just slightly less than the measured distance B seen in FIG. 3, between the inboard edges 52, 54 of the horizontal supports 16, 18, respectively. Now, viewing FIGS. 2 and 3 together, it can be appreciated that a grate oriented as seen in FIG. 2 will neatly fit up and through a grate oriented at a right angle, as seen in FIG. 3, to the one seen in FIG. 2, since dimension A is less than dimension B. Sequentially, then, additional grates, as shown in Figure 4, may be stacked up, adjacent ones being at right angles to one another, and thus a stable, tidy, space-saving arrangement of fireplace grates is provided. Since the grates can be so stacked in a space-saving manner, warehousing, shipment, storage and even display costs are significantly lowered.

A specific embodiment of the invention has the following dimensions; all parts are fabricated from one-half inch square stock. Each horizontal support 16, 18 has a height of 4 and ⅝ inches, with an overall length, leg tip to leg tip, of 18 and ½ inches. Base portions 32, 34 are ¼ inch above the hearth and are spaced 5 inches apart. Each V-shaped rod member 12, 14 has an overall height of 7 and ⅞ inches; each base 32, 34 is 5 and ¾ inches long and is connected to the respective arms on a ½ inch inner radius curve. The overall tip 48 to tip 48 and 50 to tip 50 distance is 14 inches. Each post 44, 46 is located centrally within its respective V-shaped rod member 12, 14 and has a height of 5 inches. Finally, the end or side support members 28, 30 have an overall length of 12 and 7/16 inches. With reference to FIG. 3, the overall outer dimension, front to rear, at the bottoms of legs 20, 22 to 24, 26, respectively, is 14 inches. The end or side support members 28, 30 are located 1 and ¼ inches above a support surface.

In all the embodiments of the invention, it will be appreciated that the instant invention affords more efficient burning or combustion in that lateral or side to side propagation of flame is greatly enhanced, as the post members neatly divide materials, logs wedged between center posts and grate sides, thus allowing for vertical spacing between logs, with the consequent advantage of increased exposure of material.

It is to be understood that the present invention is not limited to the embodiments described above, but encompasses any and all embodiments within the scope of the following claims.

I claim:

1. A fireplace grate for holding firewood and kindling within a fireplace having a front, a rear, and a hearth upon which said grate is disposed, said grate comprising:

a first and a second substantially V-shaped rod member spaced a predetermined distance from each other and inclined away from each other by a predetermined angle with respect to a vertical plane between the first and second rod member, and each having a horizontal base portion and front and rear sloping upright portions;

a front and a rear horizontal reinforcing support member, each connecting said first rod member at first intermediate points of said front and rear sloping portions of said first rod member, and each connecting said second rod member at second intermediate points of said front and rear sloping portions of said second rod member;

a first and a second post member positioned on said first and second rod member at an intermediate position on said horizontal base portion, and projecting upwardly therefrom, respectively, each said post member having a first end affixed to said horizontal base portion and an opposite second end, said first end for neatly dividing the kindling supported by said horizontal base portions into two distinct quantities spaced from one another, said second end and said front and rear sloping upright portions being dimensioned and configured to contact and support a stack of firewood pieces in an elevated position above the kindling in order to neatly divide the firewood into two distinct, front-to-rear quantities spaced from one another; whereby lateral flame propagation along the underside of the firewood is enhanced due to a lack of contact with said horizontal base portions, and smoke generation is retarded due to an upward draft created by the two distinct quantities of firewood, aiding ignition and combustion of the firewood.

2. The fireplace grate according to claim 1, wherein said V-shaped rod member front and rear sloping upright portions terminate in a pair of front upper tip ends and a pair of rear upper tip ends and thus define a front distance between said front upper tip ends and a rear distance between said rear upper tip ends, a first separation distance being defined between said first intermediate points connecting said first rod member to said horizontal support members and a second separation distance being defined between said second intermediate points connecting said second rod member to said horizontal support members, parts being dimensioned and configured such that said separation distances are greater than said front and rear distances, whereby multiples of said fireplace grates may be stacked vertically and successively at right angles between adjacent grates, the front and rear tips of one grate fitting up and through the horizontal support members of an adjacent fireplace grate, thus to minimize space occupied by multiple grates and to provide a stable and safe stack of grates.

3. The fireplace grate according to claim 2 wherein said separation distances are equal to one another, and wherein said front and rear distances are equal to one another.

4. The fireplace grate according to claim 3, wherein said first and second post members are configured so as to lie within planes defined by the angles of inclination of said first and second V-shaped rod members, respectively.

5. The fireplace grate according to claim 2, wherein said first and second post members are configured so as to lie within planes defined by the angles of inclination of said first and second V-shaped rod members, respectively.

6. The fireplace grate according to claim 1, wherein each said horizontal base portion is elevated from the hearth, and each said horizontal reinforcing support member comprises a horizontal central leg portion and descending outer leg portions contacting the hearth, each said horizontal central leg portion, each said descending outer leg portion, and each said V-shaped rod member being dimensioned and configured to cooperatively define a first unobstructed, front-to-rear tunnel between said V-shaped rod members and each said horizontal central leg portion, and a second and a third unobstructed, front-to-rear tunnel between each said V-shaped rod member and each said descending outer leg portion, respectively, whereby a user can conveniently remove ash with a conventional fireplace shovel, while said grate remains in place in the fireplace.

7. The fireplace grate according to claim 6, wherein said V-shaped rod member front and rear sloping upright portions terminate in a pair of front upper tip ends and a pair of rear upper tip ends and thus define a front distance between said front upper tip ends and a rear distance between said rear upper tip ends, a first separation distance being defined between said first intermediate points connecting said first rod member to said horizontal support members and a second separation distance being defined between said second intermediate points connecting said second rod member to said horizontal support members, parts being dimensioned and configured such that said separation distances are greater than said front and rear distances, whereby multiples of said fireplace grates may be stacked vertically and successively at right angles between adjacent grates, the front and rear tips of one grate fitting up and through the horizontal support members of an adjacent fireplace grate, thus to minimize space occupied by multiple grates and to provide a stable and safe stack of grates.

8. The fireplace grate according to claim 7 wherein said separation distances are equal to one another, and wherein said front and rear distances are equal to one another.

9. The fireplace grate according to claim 8, wherein said first and second post members are configured so as to lie within planes defined by the angles of inclination of said first and second V-shaped rod members, respectively.

10. The fireplace grate according to claim 7, wherein said first and second post members are configured so as to lie within planes defined by the angles of inclination of said first and second V-shaped rod members, respectively.

* * * * *